US007048412B2

(12) United States Patent
Martin et al.

(10) Patent No.: US 7,048,412 B2
(45) Date of Patent: May 23, 2006

(54) AXIAL LED SOURCE

(75) Inventors: Paul S. Martin, Pleasanton, CA (US); R. Scott West, Wixom, MI (US); Daniel A. Steigerwald, Cupertino, CA (US)

(73) Assignee: Lumileds Lighting U.S., LLC, San Jose, CA (US)

( * ) Notice: Subject to any disclaimer, the term of this patent is extended or adjusted under 35 U.S.C. 154(b) by 249 days.

(21) Appl. No.: 10/166,853

(22) Filed: Jun. 10, 2002

(65) Prior Publication Data

US 2003/0227774 A1 Dec. 11, 2003

(51) Int. Cl.
*F21V 7/00* (2006.01)

(52) U.S. Cl. ..... 362/247; 362/545; 362/507

(58) Field of Classification Search ..... 362/507, 362/510, 516–517, 543–545, 235–240, 241, 362/247, 245, 348, 215
See application file for complete search history.

(56) References Cited

U.S. PATENT DOCUMENTS

| | | | | | |
|---|---|---|---|---|---|
| 4,588,883 | A | * | 5/1986 | Abbas | 250/205 |
| 5,506,760 | A | * | 4/1996 | Giebler et al. | 362/249 |
| 5,655,830 | A | | 8/1997 | Ruskouski | 362/240 |
| 6,164,798 | A | | 12/2000 | Wordin | 362/297 |
| 6,190,020 | B1 | | 2/2001 | Hartley | 362/184 |
| 6,320,182 | B1 | | 11/2001 | Hubble, III et al. | 250/216 |
| 6,350,041 | B1 | | 2/2002 | Tarsa et al. | 362/231 |
| 6,412,971 | B1 | | 7/2002 | Wojnarowski et al. | 362/249 |
| 6,525,668 | B1 | * | 2/2003 | Petrick | 340/815.45 |
| 6,573,536 | B1 | | 6/2003 | Dry | 257/88 |
| 6,682,211 | B1 | | 1/2004 | English et al. | |
| 2003/0063474 | A1 | | 4/2003 | Coushaine | |
| 2003/0063476 | A1 | | 4/2003 | English et al. | |
| 2003/0103348 | A1 | * | 6/2003 | Hung | 362/247 |
| 2003/0107046 | A1 | | 6/2003 | Waitl et al. | |

FOREIGN PATENT DOCUMENTS

| | | | |
|---|---|---|---|
| EP | 1 298 382 A1 | | 4/2003 |
| EP | 1 298 383 A2 | | 4/2003 |
| WO | 9957945 | * | 11/1999 |
| WO | WO 01/24583 A1 | | 4/2001 |
| WO | WO 02/52190 | * | 4/2002 |
| WO | WO 03/059013 A1 | | 7/2003 |

* cited by examiner

*Primary Examiner*—Ali Alavi
(74) *Attorney, Agent, or Firm*—Patent Law Group LLP; David C. Hsia

(57) ABSTRACT

A lamp has LED sources that are placed about a lamp axis in an axial arrangement. The lamp includes a post with post facets where the LED sources are mounted. The lamp includes a segmented reflector for guiding light from the LED sources. The segmented reflector includes reflective segments each of which is illuminated primarily by light from one of the post facets (e.g., one of the LED sources on the post facet). The LED sources may be made up of one or more LED dies. The LED dies may include optic-on-chip lenses to direct the light from each post facet to a corresponding reflective segment. The LED dies may be of different sizes and colors chosen to generate a particular far-field pattern.

40 Claims, 16 Drawing Sheets

AXIAL LED SOURCE

FIELD OF THE INVENTION

This invention relates to light emitting diodes ("LEDs") and in particular to lamps with multiple LED sources.

DESCRIPTION OF RELATED ART

FIG. 1A illustrates a conventional lamp 100A using a filament bulb 102A. Filament bulb 102A is located perpendicular to a lamp axis 104A in a trans-axial arrangement. Lamp axis 104A is an axis generally along the direction of light emission. A reflector 106A shapes (e.g., collimates) a number of light rays from bulb 102A to form a desired far-field pattern. However, a number of light rays do not strike reflector 106A and therefore do not contribute to the desired pattern. This reduces the flux in the desired pattern and the control over the shape of the desired pattern.

FIG. 1B illustrates a conventional lamp 100B using a filament bulb 102B that is aligned with a lamp axis 104B in an axial arrangement. Due to the axial arrangement, a greater number of light rays strike reflector 106B and contribute to a desired far-field pattern. Thus, the flux of the desired pattern increases and the control over the shape of the desired pattern improves.

FIGS. 1C and 1D illustrate a conventional lamp 100C using an array 102C of individual LEDs. LED array 102C is located in a plane normal to a lamp axis 104C in a trans-axial arrangement. Similar to lamp 100A, a number of light rays do not strike reflector 106C and therefore do not contribute to a desired far-field pattern.

It is desirable to control the far-field pattern of a lamp. For example, in automotive applications, it is critical to design headlamps that do not generate glares into oncoming traffic. Generally, it is difficult to create a pattern with a small spot size that has high candela values with a sharp cut off. If that can be accomplished, patterns with larger spots sizes and different shapes can be readily achieved.

It is also desirable to reduce the size of the light source of a lamp. Reducing the source size offers packaging freedom to produce different lamp designs with new styling. As the source size becomes smaller, the focal length of the reflector used to guide the light can also become smaller. However, as the focal length becomes too small, it becomes difficult to align the focus of the reflector to the light source in the manufacturing process.

Thus, what is needed is an LED lamp that addresses the problems described above.

SUMMARY OF THE INVENTION

In one embodiment of the invention, a lamp includes a post aligned along a lamp axis, a number of LED sources, and a reflector for guiding light primarily along the lamp axis. The post includes a number of post facets. The LED sources are each mounted on one of the post facets so normal vectors to light emitting surfaces of the LED sources are approximately perpendicular to the lamp axis. The reflector is divided into reflective segments each illuminated primarily by light from one of the post facets.

In one embodiment, each of the LED sources is a monolithic LED die with an array of LEDs, an array of individual LEDs, or an individual LED. In one embodiment, each of the LEDs includes an optic-on-chip lens atop of its light emitting surface to control its solid angle of light emission so each LED primarily emits light onto one of the reflective segments.

Accordingly, the lamp has reflective segments that are each tailored to one of the LED sources to project a part of a desired pattern. The LED sources can be a monolithic LED die to reduce source size. The LED sources can be fitted with optic-on-chip lenses to direct light from a post facet to a corresponding reflective segment.

In one embodiment of the invention, a method for generating a far-field pattern with a lamp having LED sources on post facets of a post aligned with a lamp axis and a reflector including reflective segments each illuminated primarily by light from one of the post facets, includes independently controlling (1) a first LED source on a first post facet and (2) a second LED source on a second post facet to generate the far-field pattern. In one embodiment, independently controlling the first and the second LED sources includes independently changing current levels to (1) the first LED source and (2) the second LED source to shape the far-field pattern. In one embodiment, the first and the second LED sources generate at least partially overlapping patterns in the far-field pattern. In another embodiment, the first and the second LED sources generate non-overlapping patterns in the far-field pattern.

In one embodiment, the first and the second LED sources generate lights of different colors. In one embodiment, independently controlling the first and the second LED sources includes independently changing current levels to (1) the first LED source and (2) the second LED source to generate the far-field pattern and color(s).

Accordingly, the light pattern of the lamp is changed without physical mechanism. Instead, the light pattern of the lamp is changed by changing the current levels to specific LED sources.

DETAILED DESCRIPTION

Figure 1A:
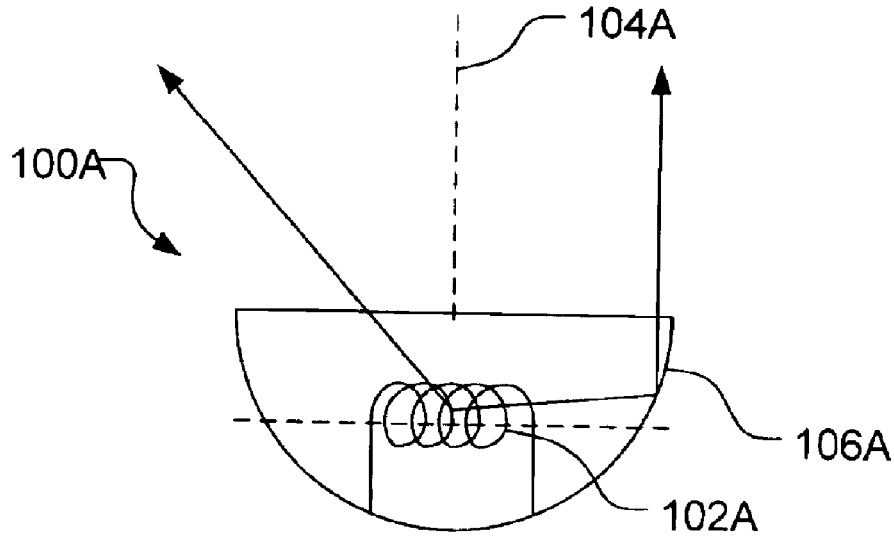
FIG. 1A (Prior Art)
FIGS. 1A and 1B illustrate conventional lamps with filament light sources in trans-axial and axial arrangements, respectively.
Figure 1B:
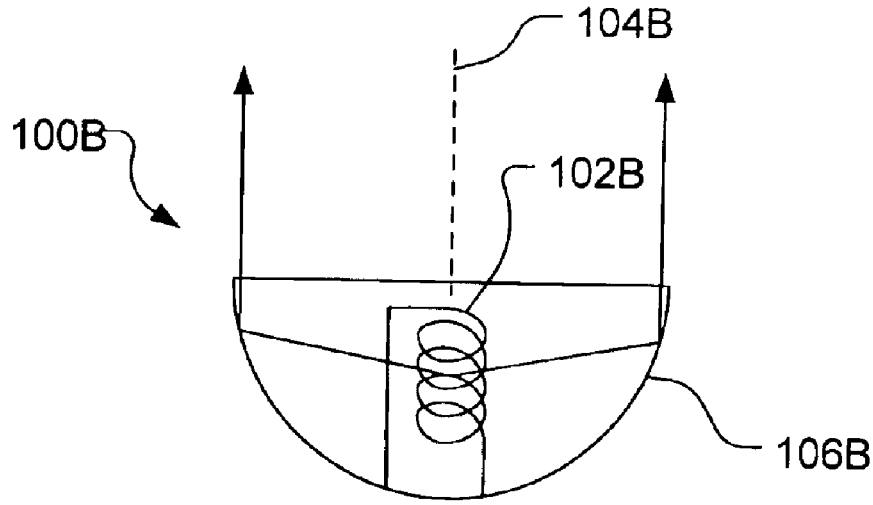
FIG. 1B (Prior Art)
Figure 1C:
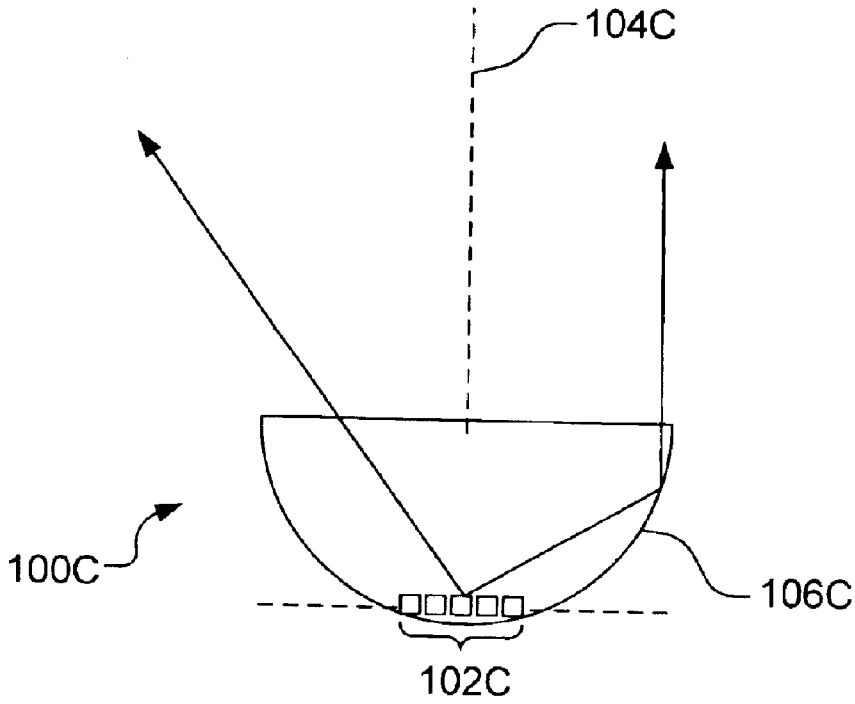
FIG. 1C (Prior Art)
FIGS. 1C and ID illustrate a conventional lamp with an LED light source in a trans-axial arrangement.
Figure 1D:
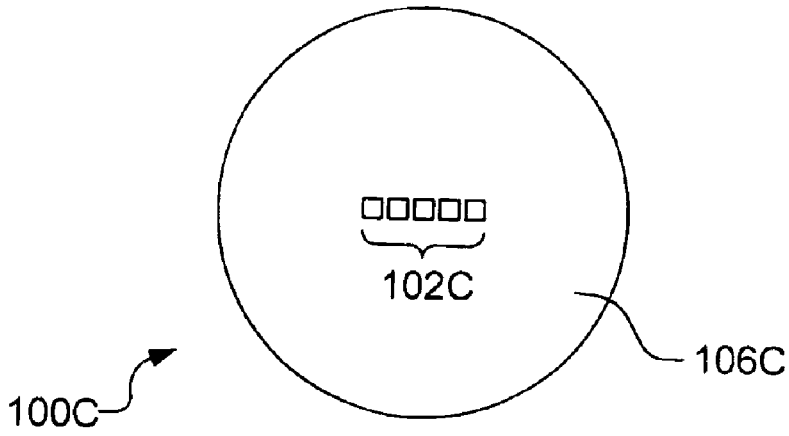
FIG. 1D (Prior Art)
Figure 2A:
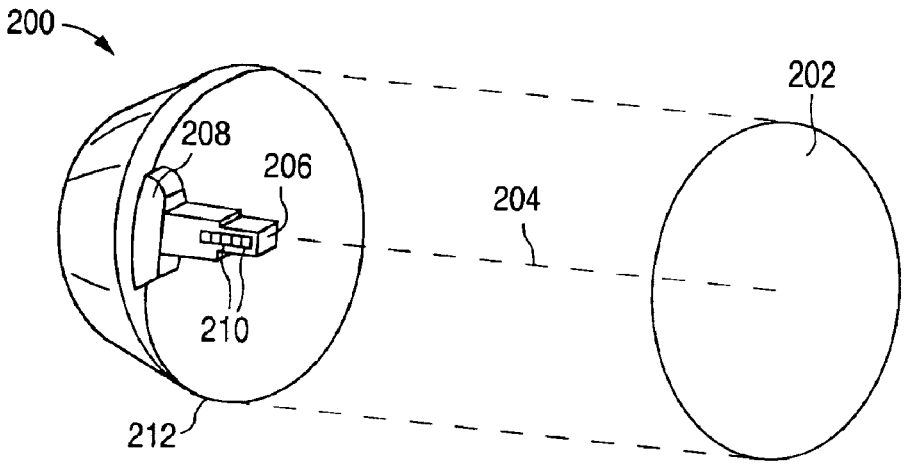
FIGS. 2A, 2B, and 2C illustrate perspective views of a lamp with an axial LED light source in the embodiments of the invention.
Figure 2B:
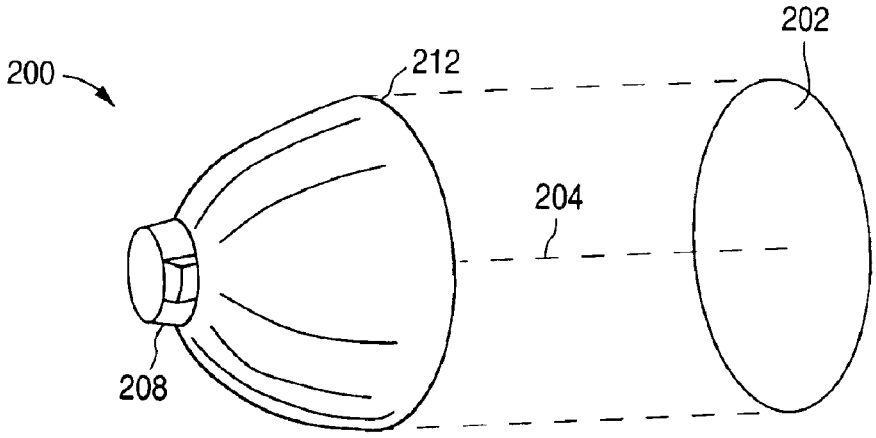

FIGS. 2A and 2B illustrate perspective views of a lamp 200 in the embodiments of the invention. Lamp 200 generates a far-field pattern 202 about a lamp axis 204. Lamp axis 204 is generally along the direction of light emission. Pattern 202 can be shaped for a variety of applications, including automotive, directional (e.g., similar to MR, AR, PAR projection lights), retail, hospitality, and commercial lighting.

Lamp 200 includes a base 208 (e.g., a socket) that can be plugged into an electrical receptacle to receive power and control signals. A post 206 extends from base 208 along lamp axis 204. Post 206 can be made in a variety of shapes (described later) to provide a number of post facets where one or more LED light sources are mounted. Post 206 includes the necessary electrical wiring for coupling the LED light sources to external power and control signals received at base 208.

Although only one LED source 210 is visible in FIG. 2A, any number of LED sources 210 can be mounted to post 206. LED sources 210 are placed about lamp axis 204 in an axial arrangement where each LED source 210 is mounted to a post facet so a normal vector to its light emitting surface is approximately perpendicular to lamp axis 204. The normal vector may not be exactly perpendicular to lamp axis 204 because the post facets may be angled relative to lamp axis 204 to improve optical collection and/or heat dissipation (both described later). With an axial design, the luminous flux for a particular source length along a lamp axis can be increased by adding additional post facets and LED sources. Furthermore, the size of base 208 can be reduced because the LED sources do not lie in a plane perpendicular to lamp axis 204. This reduces light loss due to light striking base 208 instead of reflector 212.

Figure 2C:
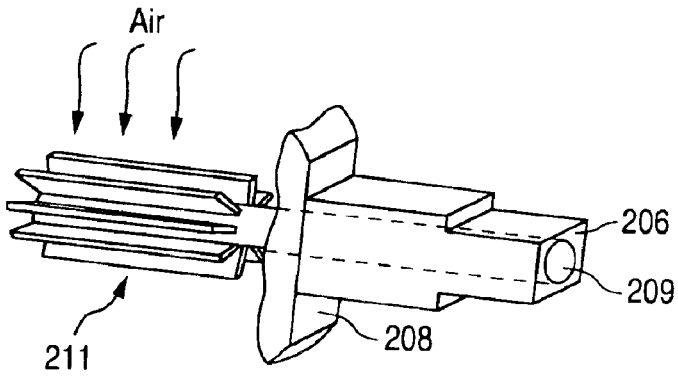
Figure 2D:
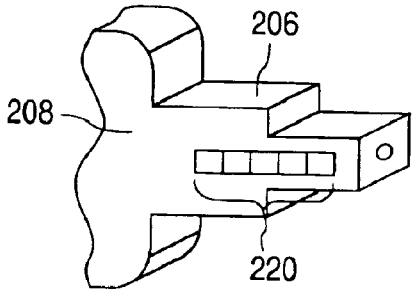
FIGS. 2D, 2E, and 2F illustrate various LED sources on a post facet in embodiments of the invention.
Figure 2E:
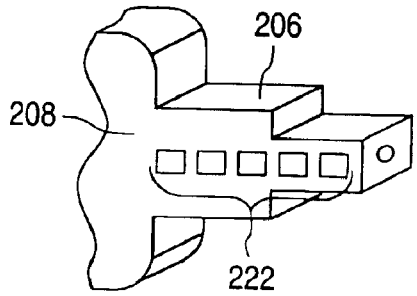
Figure 2F:
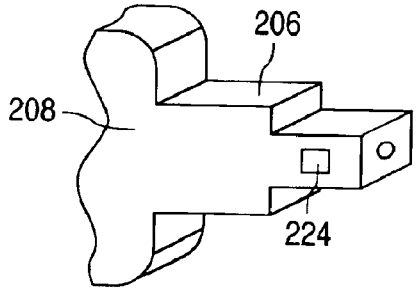

Depending on the application, each LED source 210 can be a monolithic die 220 (FIG. 2D) with an array of LEDs, an array 222 (FIG. 2E) of individual LEDs, or one individual LED 224 (FIG. 2F). The monolithic die includes a serial or parallel LED array formed on a highly resistive substrate such that both the p- and n- contacts for the array are on the same side of the array and the individual LEDs are electrically isolated from each other by trenches or by ion implantation. The monolithic die is further described in a commonly assigned U.S. patent application Ser. No. 09/823,824, which is incorporated by reference in its entirety.

A segmented reflector 212 is mounted to base 208. Segmented reflector 212 is divided into a number of reflective segments. A reflector segment is a region that is optimized for an emitting area on a post facet (e.g., one or more LED sources on the post facet). In other words, a reflective segment has its focus at the emitting area on a post facet so it is primarily illuminated by light from one post facet. Each reflective segment can be a smooth simple surface, a smooth complex surface, or divided into a number of sub-segments called facets. Facets are typically used to manage light in the far field pattern.

Unlike a filament light source that emits into a sphere, LED source 210 emits into a hemisphere. Thus, segmented reflector 212 can be divided into reflective segments that each receives light primarily from one LED source 210 on a post facet. The reflective segments can project light into different parts of pattern 202. Alternatively, the reflective segments can project light to at least partially overlay each other in pattern 202.

Segmented reflector 212 is asymmetric because each reflective segment is optimized for an individual LED source. Thus, lamp 200 has a very small effective source size. As the normal vectors to the LED sources 210 are approximately perpendicular to lamp axis 204, a majority of the light will strike and be shaped by the reflective segments. For these reasons, lamp 200 can provide high flux and/or candela values.

In a typical lamp design, the end product is expected to fit within certain physical dimensions and meet certain performance criteria. A designer will match a reflector with a particular focal length with a light source of a particular size to conform to these requirements. To properly control the light from a light source, smaller focal lengths will be matched with smaller source sizes. However, smaller focal lengths require better source placement during manufacturing. As described above, LED source 210 in lamp 200 can be a monolithic die with an array of LEDs or an array of individual LEDs. The size of the LED array determines the aspect ratio (height divided by length) of the LED source.

Thus, the aspect ratio can be changed to match a variety of focal lengths to conform to the dimensional and performance requirements. This offers more mechanical freedom in the design of lamp 200.

Considerations of heat transfer and heat dissipation are important for solid-state lights, such as lamp 200. Reliability is dependent on maintaining the temperature of the LED sources within designed ranges. Luminous performance of the LED sources is also reduced at elevated temperatures. Maintaining the temperature of lamp 200 requires that heat be transferred away from the LED sources and then dissipated into the surrounding environment.

Heat transfer can be accomplished by optical radiation or by thermal conduction. Radiation heat transfer is dependent on the temperature of the source (raised to the fourth power) and on the emissivity of the body. However, at the allowed temperatures for LED sources, radiation is not a large fraction of the total heat load. Selecting the post material to have a high emissivity can maximize the radiation component of heat transfer. Heat conduction is largely through the axial post. The material for the post should have a high thermal conductivity and should generally be a metal.

Accordingly, post 206 can be made of thermally conductive material to transfer heat away from LED sources 210 and toward base 208. Good materials for post 206 include aluminum and copper. In one embodiment, post 206 is made of black anodized aluminum to provide excellent heat conduction while maximizing the emissivity and the optical radiation. The shape of the post can be selected to minimize the thermal impedance (described later).

In one embodiment, a heat pipe is used to increase the thermal conduction away from LED sources 210 and toward base 208. Heat pipes are conventional devices that use an evaporation-condensation cycle to transfer heat from one point to another. FIG. 2C illustrates one embodiment where a heat pipe 209 is inserted axially into post 206 and transfers the heat to external features that would dissipate the heat into the environment through convection. A physical connection between axial heat pipe 209 and post 206 would be required to provide adequate heat transfer to the heat pipe. In one embodiment, axial heat pipe 209 has incrementing cross-section along its length toward base 208 to improve conduction of heat away from the LED sources.

An additional feature could be used to remove the heat from the heat pipe and transfer it to the surrounding air. Heat pipe 209 can be mounted to a heat sink/condenser 211 that dissipates the heat through convection. In one embodiment, heat sink 211 consists of fins attached to the surface of heat pipe 209. Heat sink 211 could be a separate component or could be part of base 208. The convective heat transfer can be greatly improved by designing air flow over the surface of heat sink 211.

Figure 2G:
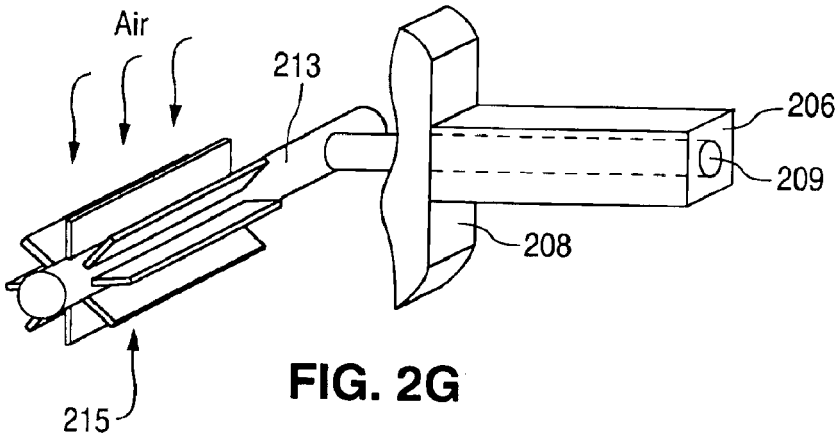
FIG. 2G illustrates a lamp post with an axial heat pipe coupled to a lateral heat pipe to transfer heat away from the LED sources in one embodiment.

FIG. 2G illustrates one embodiment where axial heat pipe 209 is coupled to a lateral heat pipe 213 to transfer heat to an area of high air flow. Heat pipe 209 can include a threaded base that is received into a threaded bore of lateral heat pipe 213. Heat pipe 213 can include a heat sink 215 to dissipate heat.

Figure 3A:
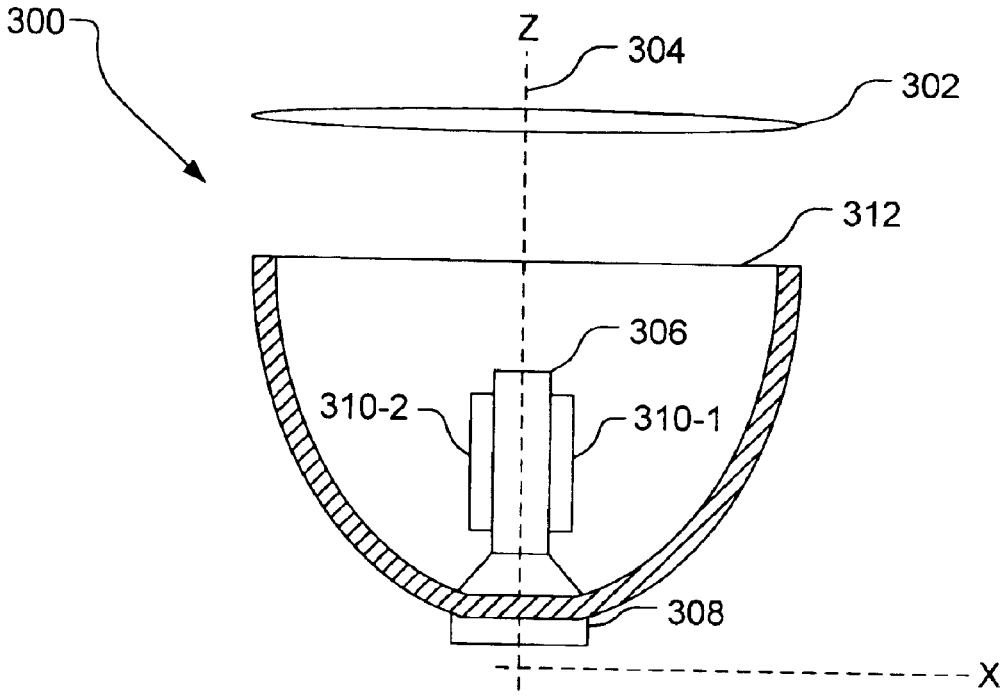
FIGS. 3A and 3B illustrate side and top views of one embodiment of the lamp in FIGS. 2A–2C with two axial LED sources.
Figure 3B:
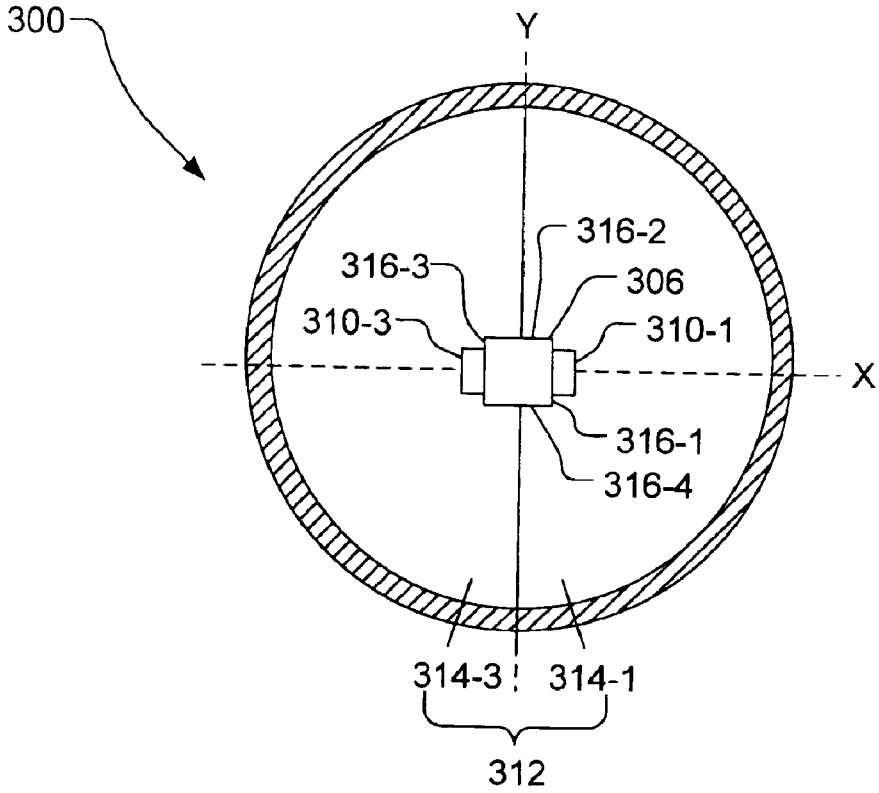

FIGS. 3A and 3B illustrate one embodiment of lamp 200 (hereafter "lamp 300") with two LED sources. In this embodiment, a post 306 has a rectangular cross-section along its length. Thus, post 306 has four post facets 316-1, 316-2, 316-3, and 316-4 (FIG. 3B). LED source 310-1 and 310-3 are mounted on post facets 316-1 and 316-3, respectively. Although the LED sources are shown protruding from the post facets, they may be mounted into recesses in the post facets so they do not protrude above the post facets.

In this embodiment, a segmented reflector 312 includes a first reflective segment 314-1 with its focus at LED light source 310-1, and a second reflective segment 314-3 with its focus at LED light source 310-3. Depending on the embodiment, reflective segments 314-1 and 314-3 are shaped to provide a far-field pattern 302. For example, reflective segments 314-1 and 314-3 can be shaped to collimate or diffuse their light. Further more, reflective segments 314-1 and 314-3 can be shaped to partially or entirely overlap their light. Depending on the embodiment, reflective segments 314-1 and 314-3 may have different shapes or sizes from each other. For example, reflective segment 314-1 may be shaped to collimate the light while reflective segment 314-3 may be shaped to diffuse the light.

Figure 4:
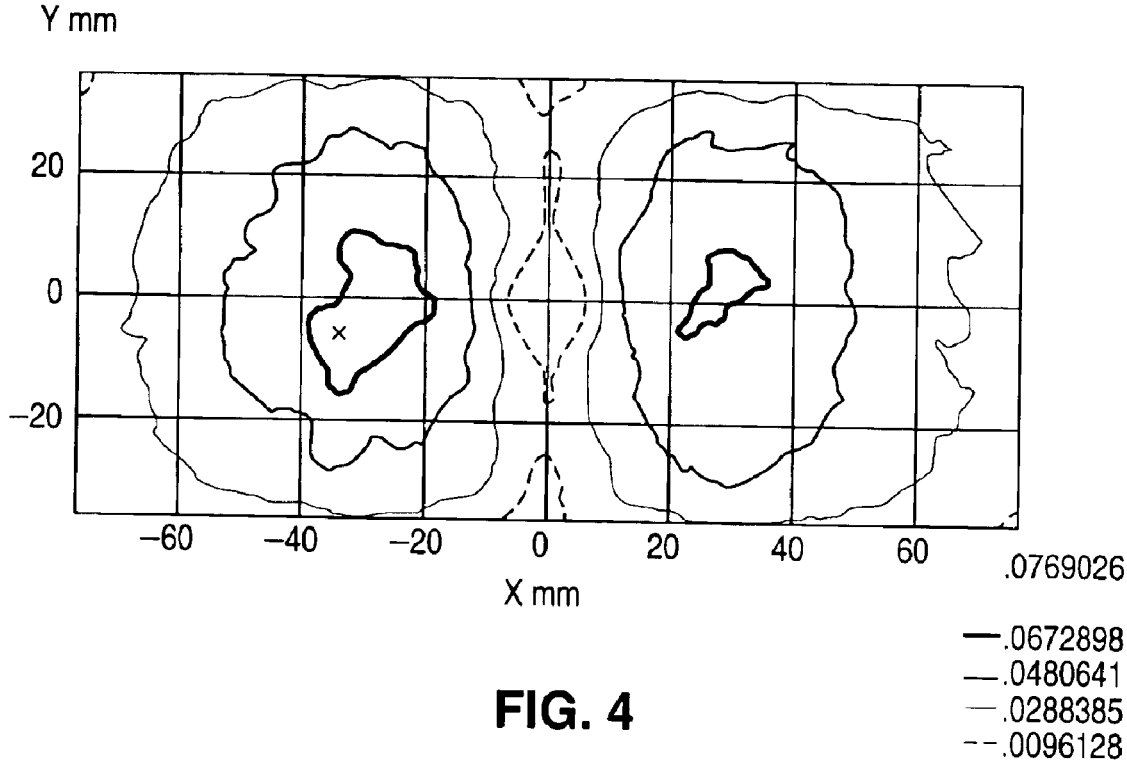
FIG. 4 illustrates the flux/mm$^2$ on the reflector of the lamp in FIGS. 3A and 3B.
Figure 5:
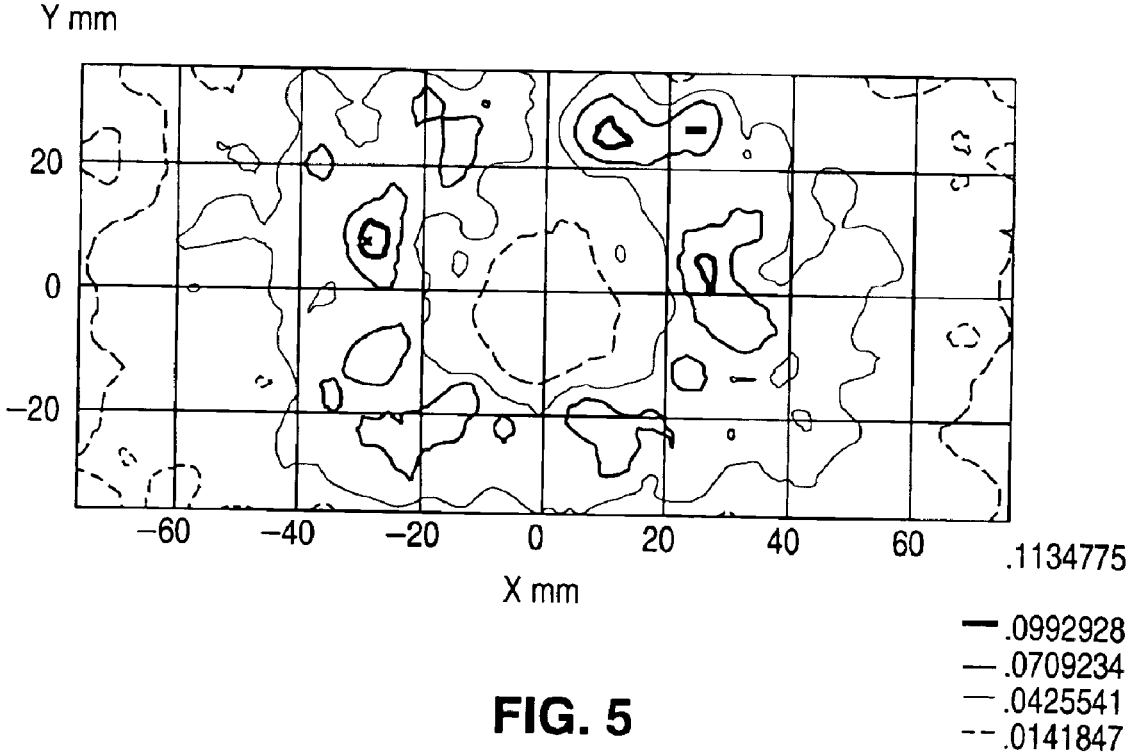
FIG. 5 illustrates the flux/mm$^2$ on the reflector of a conventional lamp with a filament light source in an axial arrangement.

FIG. 4 illustrates computer simulated flux/mm2 on a segmented reflector 312 for lamp 300. Segmented reflector 312 has an area of 150 by 70 mm and a focal length of 31.75 mm. LED sources 310-1 and 310-2 are assumed to be 1 by 5 array of individual LEDs where each LED has a die area of 1.2 by 1.2 mm. For comparison reasons, FIG. 5 illustrates computer simulated flux/mm2 on a 150 by 70 mm reflector for a conventional automotive headlamp using a 9006 bulb.

As can be seen, reflector 312 has a more uniform distribution of candela values. The candela values have consistent rectangular shapes that uniformly fill reflector 312. The uniform fill of reflector 312 is cosmetically pleasing to consumers because lamp 300 appears to be uniformly lit. Reflector 312 also has a higher collection efficiency of 443 lumens compared to 428 lumens for the conventional headlamp. Higher collection efficiency means that reflector 312 will have more control over the light and that lamp 300 will generate higher candela values. For these reasons, lamp 300 and other embodiments of lamp 200 are suited for generating a bright and controllable pattern 202.

Figure 6:
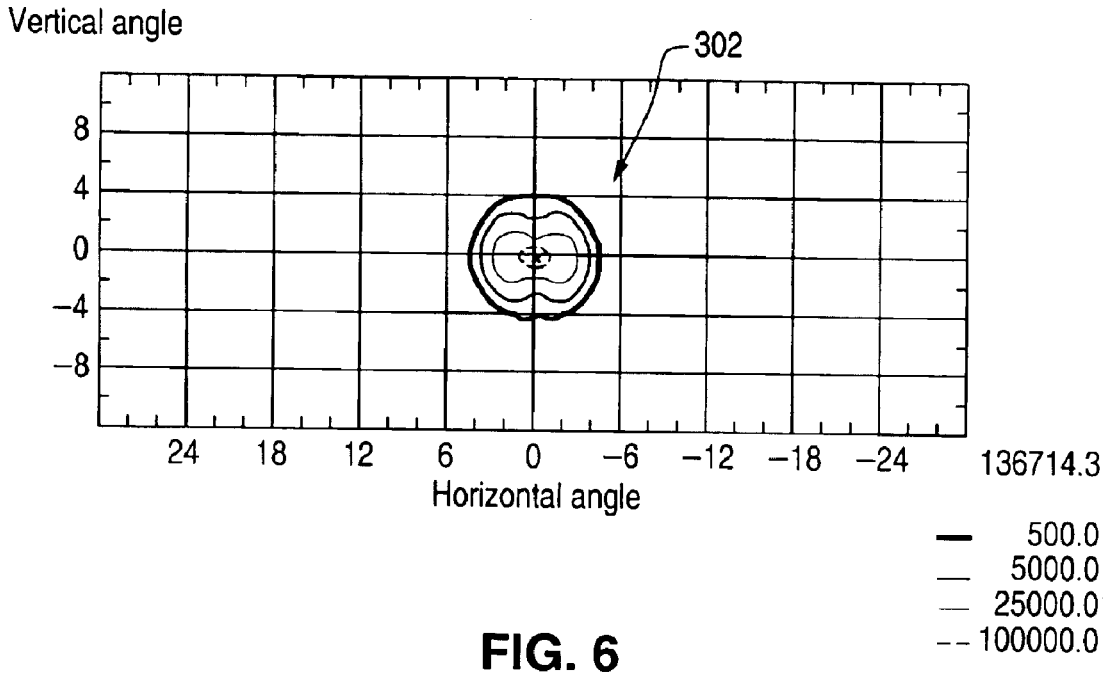
FIG. 6 illustrates the candela values of a light pattern generated by the lamp of FIGS. 3A and 3B in one embodiment.
Figure 7:
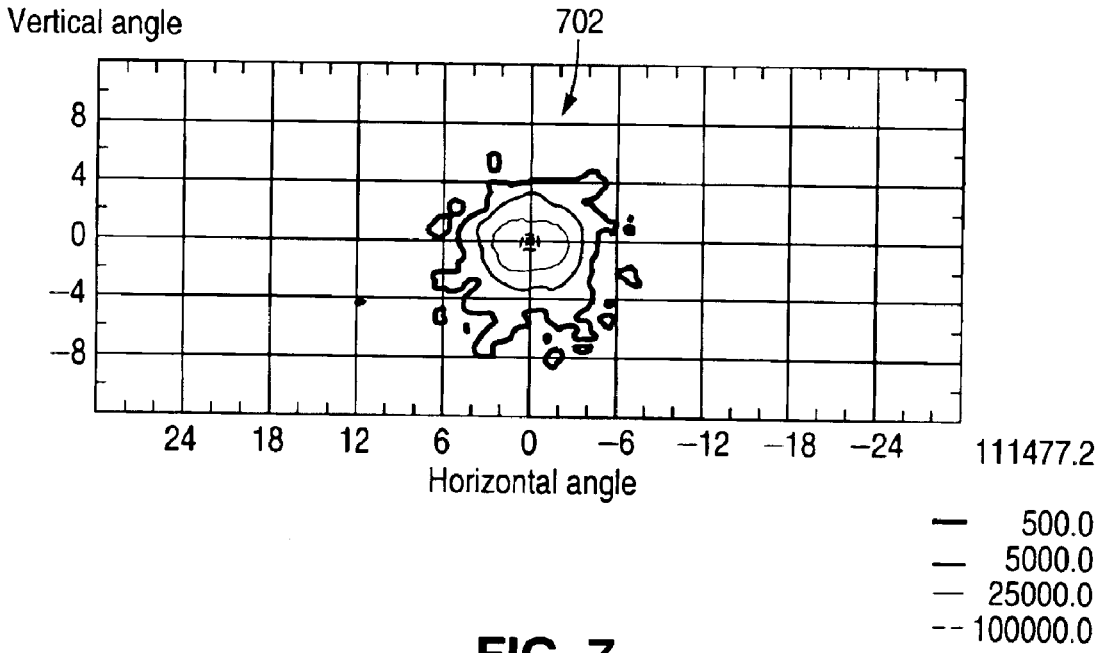
FIG. 7 illustrates the candela values of a light pattern generated by a conventional lamp with a filament light source in an axial arrangement.

FIG. 6 illustrates computer simulated candela values of a far-field pattern 302 generated by lamp 300 in one embodiment. For comparison reasons, FIG. 7 illustrates computer simulated candela values of a pattern 702 generated by the conventional headlamp with a standard 9006 bulb. FIGS. 6 and 7 show that lamp 300 produces a smaller circular pattern 302 that has high candela values but little noise around the perimeter. The conventional headlamp produces a larger circular pattern with lower candela values and more noise around the perimeter. Overall, lamp 300 generates a higher flux of 400 lumens compared with 365 lumens of the conventional headlamp. For these reasons, lamp 300 shows that it is cable of generating a bright and controllable pattern 302.

Figure 8A:
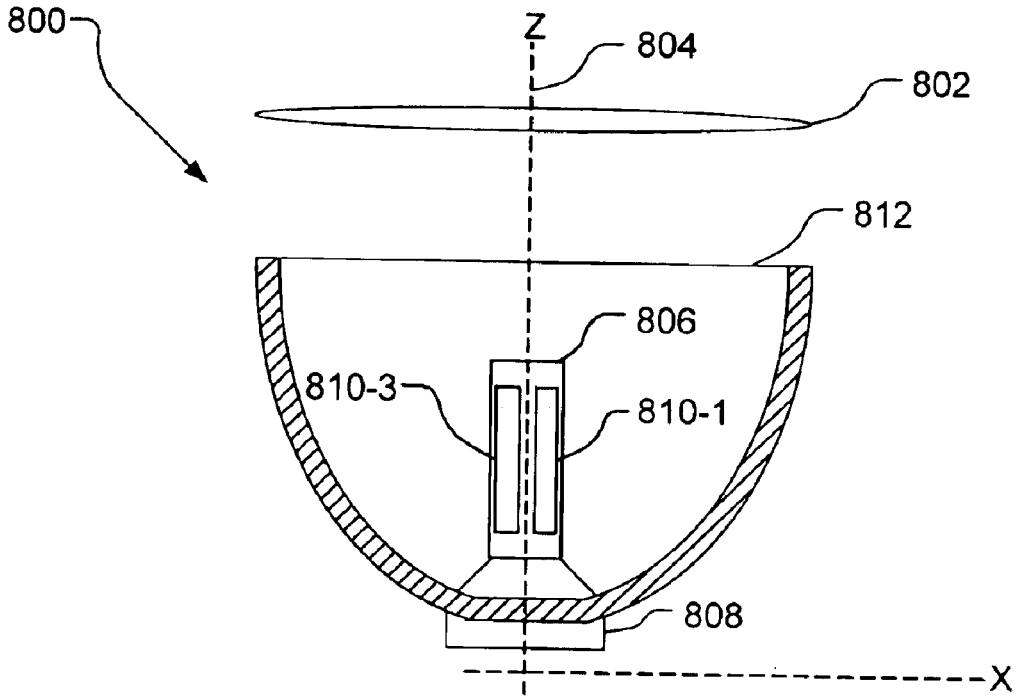
FIGS. 8A and 8B illustrate side and top views of one embodiment of the lamp in FIGS. 2A–2C with three axial LED sources.
Figure 8B:
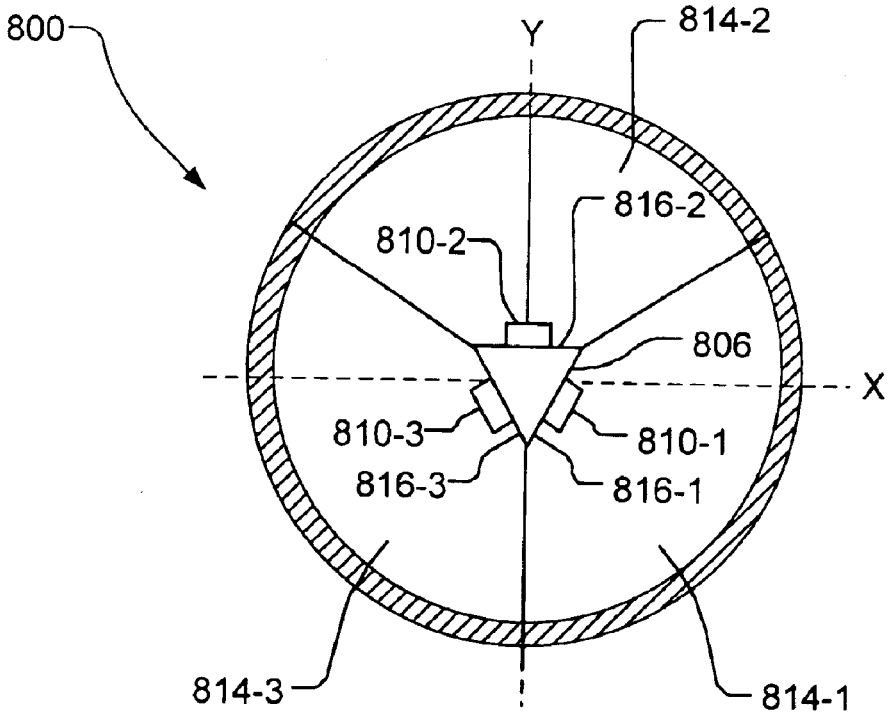

FIGS. 8A and 8B illustrate another embodiment of lamp 200 (hereafter "lamp 800") with three LED sources. In this embodiment, a post 806 has a triangular cross-section along its length. FIG. 8B illustrates that post 806 has three post facets 816-1, 816-2, and 816-3. LED sources 810-1, 810-2, and 810-3 are mounted on post facet 816-1, 816-2, and 816-3, respectively. In this embodiment, a segmented reflector 812 includes a reflective segment 814-1 with its focus at LED source 810-1, a reflective segment 814-2 with its focus at LED source 810-2, and a reflective segment 814-3 with its focus at LED light 810-3. As in the above embodiments, segmented reflector 812 is asymmetric so that each reflective segment is tailored to an individual LED source. Depending on the application, reflective segments 814-1, 814-2, and 814-3 can partially or entirely overlay their light to form a far-field pattern 802.

Figure 9:
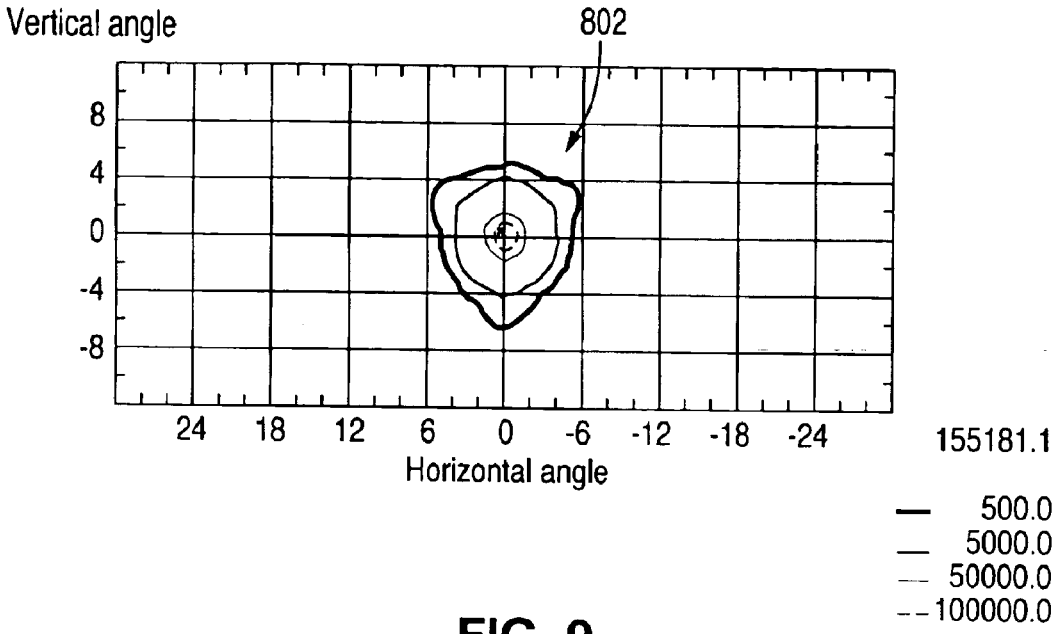
FIG. 9 illustrates the candela values of a light pattern generated by the lamp of FIGS. 8A and 8B in one embodiment.

FIG. 9 illustrates computer simulated candela values of a pattern 802 generated by lamp 800 in one embodiment.

Figure 8C:
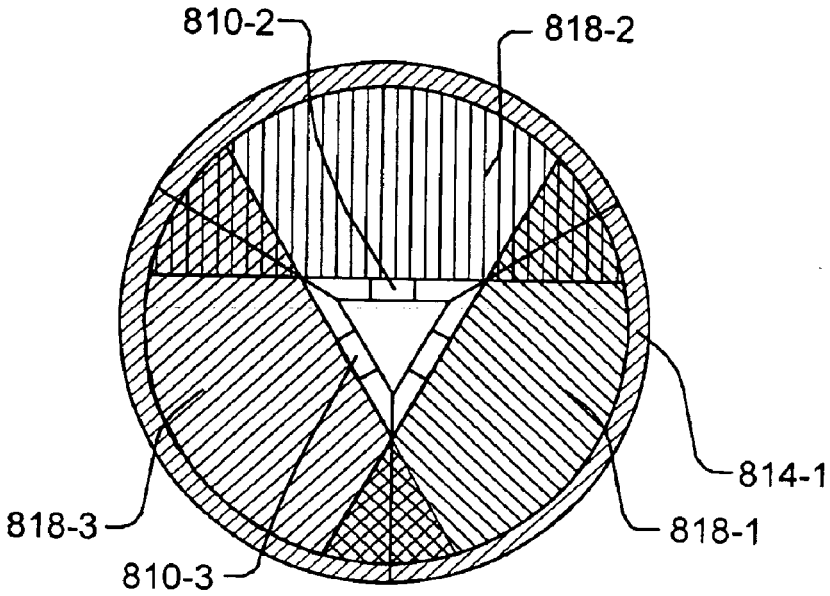
FIG. 8C illustrates the cross-talk between adjacent LED sources on the reflector in one embodiment.

Lamp 800 is assumed to have a combined source of 1000 lumens and LED sources with the same aspect ratio as lamp 300 in the examples of FIGS. 4 and 6. Lamp 800 is provided with a round reflector 812 with a diameter of 150 mm. As can be seen, lamp 800 produces a pattern 802 that is essentially circular in the center but more triangular around the perimeter. Again, pattern 802 has little noise around its perimeter. The noncircular nature of pattern 802 is caused by each reflective segment receiving light from the neighboring LED sources. FIG. 8C illustrates that there are overlaps between light from adjacent LED sources because each LED source emits into a hemisphere (shown in cross-section as a half-circle). For example, reflective segment 814-1 receives light 818-2 from LED source 810-2, light 818-3 from LED source 810-3, and light 818-1 from its own LED source 810-1. Thus, each reflective segment receives cross-talk from the neighboring LED sources.

LED sources can include LEDs (whether individual or part of a monolithic die) with optic-on-chip lenses (hereafter "OONC lenses") so embodiments of lamp 200 (e.g., lamp 800 and others described later) can better control their far-field pattern. An OONC lens is an optical element bonded to an LED die. Alternatively, the OONC lens is a transparent optical element formed on an LED die (e.g., by stamping, etching, milling, scribing, ablating). OONC lenses are further described in commonly assigned U.S. application Ser. Nos. 09/660,317, 09/880,204, and 09/823,841, which are incorporated by reference in its entirety.

Figure 8D:
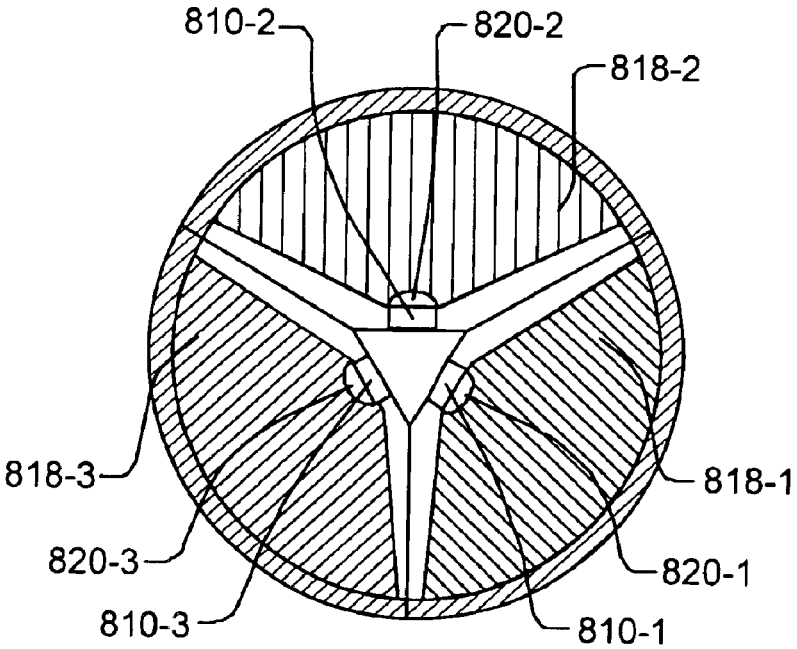
FIG. 8D illustrates the lack of cross-talk between adjacent LED sources (with optic-on-chip lenses) on the reflector in one embodiment.

The OONC lenses control the solid angles of the light emitted by the LEDs in an LED source so each LED source only illuminates its corresponding reflective segment. FIG. 8D illustrates that OONC lenses 820-1, 820-2, and 820-3 are mounted on LED sources 810-1, 810-2, and 810-3, respectively. OONC lenses 820-1 to 820-3 reduce the solid angles of the LEDs in the LED sources so each LED source primarily illuminates its corresponding reflective segment. This allows the reflective segments to precisely shape pattern 802.

Figure 10C:
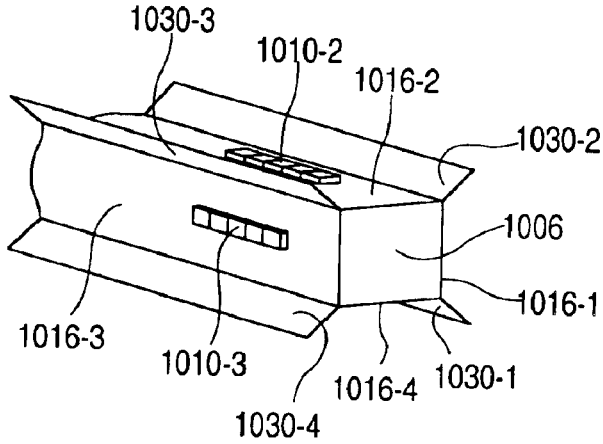
FIG. 10C illustrates a post with an optical structure to direct the light from a post facet to an intended reflective segment in one embodiment.
Figure 10A:
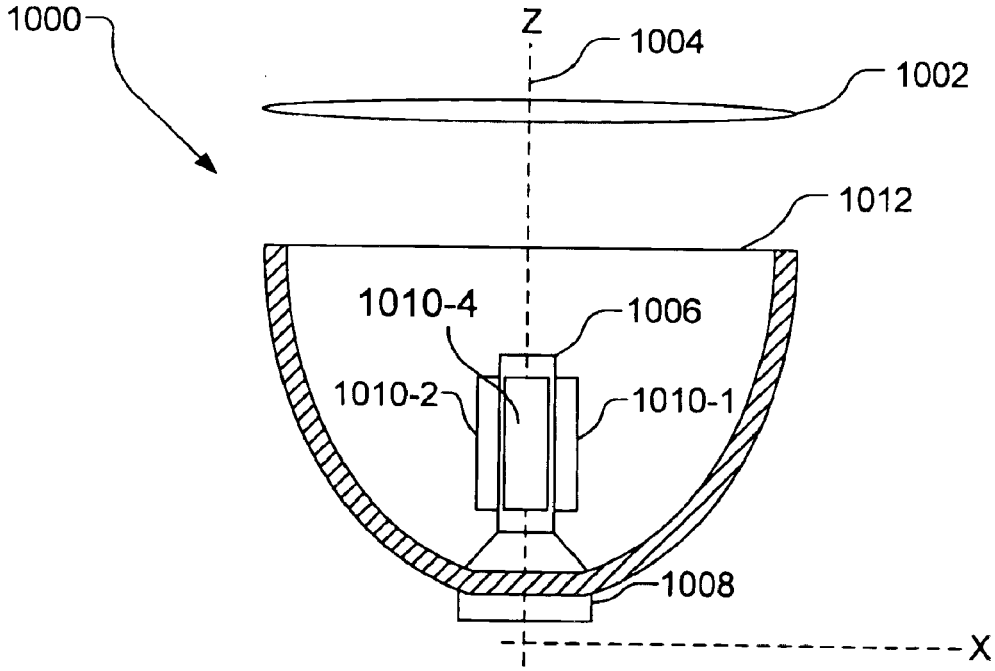
FIGS. 10A and 10B illustrate side and top views of one embodiment of the lamp in FIGS. 2A–2C with four axial LED sources.
Figure 10B:
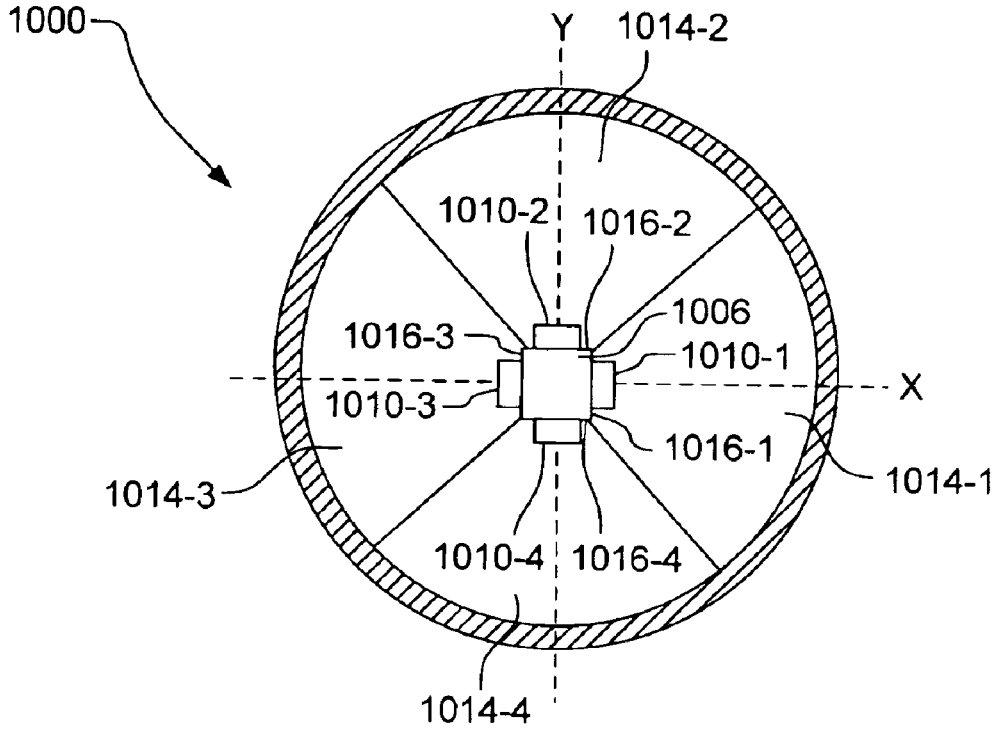

FIGS. 10A and 10B illustrate another embodiment of lamp 200 (hereafter "lamp 1000") with four LED sources. In this embodiment, a post 1006 has a rectangular cross-section along its length. FIG. 10B illustrates that post 1006 has four post facets 1016-1, 1016-2, 1016-3, and 1016-4. LED sources 1010-1, 1010-2, 1010-3, and 1010-4 are mounted on post facets 1016-1, 1016-2,1016-3, and 1016-4, respectively. In this embodiment, a segmented reflector 1012 includes a reflective segment 1014-1 with its focus at LED source 1010-1, a reflective segment 1014-2 with its focus at LED source 1010-2, a reflective segment 1014-3 with its focus at LED source 1010-3, and a reflective segment 1014-4 with its focus at LED source 1010-4. As in the above embodiments, segmented reflector 1012 is asymmetric so each reflective segment is tailored to an individual LED source. Depending on application, reflective segments 1010-1, 1010-2, 1010-3, and 1010-4 can partially or entirely overlay their light to form a far-field pattern 1002.

FIG. 10C illustrates one embodiment of post 1006 that contains an optical structure to direct the light from a post facet to a corresponding reflective segment. In one embodiment, the optical structure is composed of two reflectors 1030-2 and 1030-3 on post 1006 to reflect the light from post facet 1016-2 to the corresponding reflective segment 1014-2 (FIG. 10B). The structure may be repeated for each post facet (e.g., reflectors 1030-1 and 1030-2 for post facet 1016-1, reflectors 1030-3 and 1030-4 for post facet 1016-3, and reflectors 1030-4 and 1030-1 for post facet 1016-4). In one embodiment, each reflector has two reflective surfaces so it can be shared between adjacent post facets. For example, reflector 1030-3 is used with reflector 1030-2 to direct the light from post facet 1016-2 to reflective segment 1014-2, and reflector 1030-3 is used with reflector 1030-4 to direct the light from post facet 1016-3 to reflective segment 1014-3 (FIG. 10B). In one embodiment, the reflectors are placed close to the LED sources to minimize the source size of lamp 1000.

Figure 11:
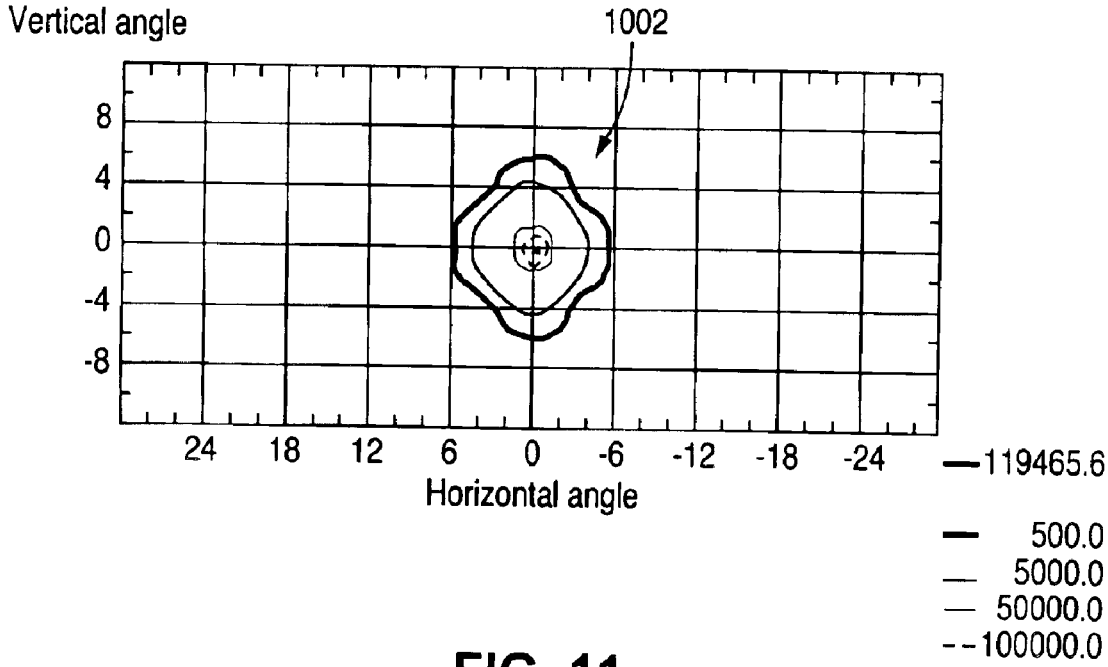
FIG. 11 illustrates the candela values of a light pattern generated by the lamp in FIGS. 10A and 10B in one embodiment.

FIG. 11 illustrates computer simulated candela values of a pattern 1002 generated by lamp 1000 in one embodiment. Lamp 1000 is assumed to have a combined source of 1000 lumens and LED sources with the same aspect ratio as lamp 300 in the examples of FIGS. 4 and 6. Lamp 1000 is provided with a round reflector 1012 with a diameter of 150 mm. As can be seen, lamp 1000 produces a pattern 1002 that is essentially circular in the center with rectangular protrusions around the perimeter. Pattern 1002 has little noise around its perimeter. Similar to lamp 800, the noncircular nature of pattern 1002 around the perimeter is caused by each reflective segment receiving cross-talk from the adjacent LED sources.

Figure 12:
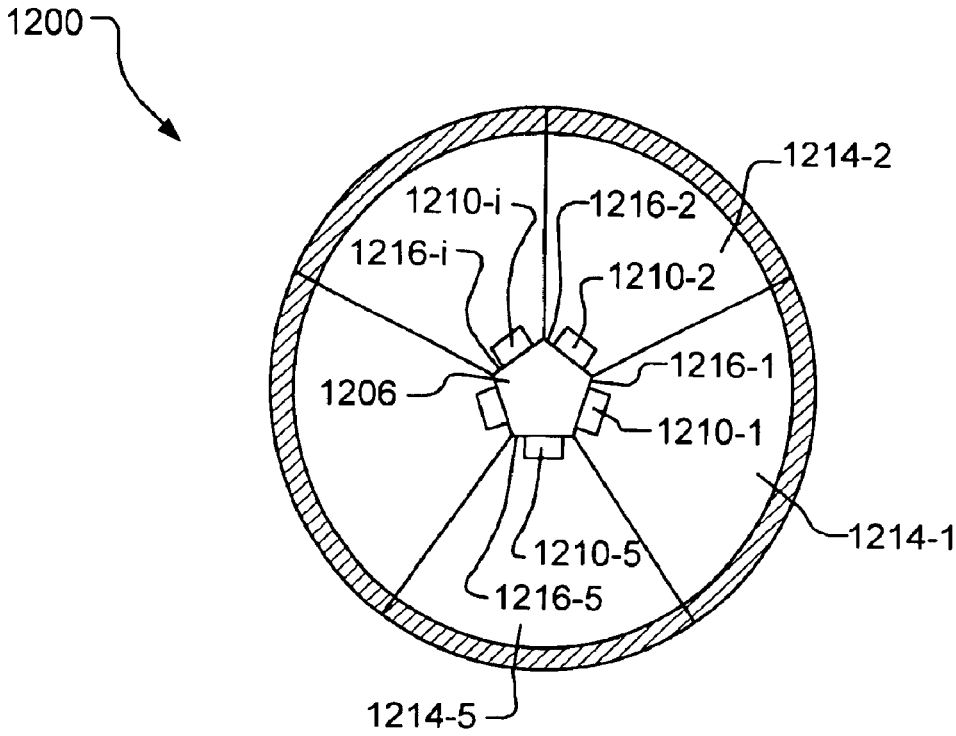
FIGS. 12 and 13 illustrate top views of embodiments of the lamp in FIGS. 2A–2C with five and six axial LED sources, respectively.
Figure 13:
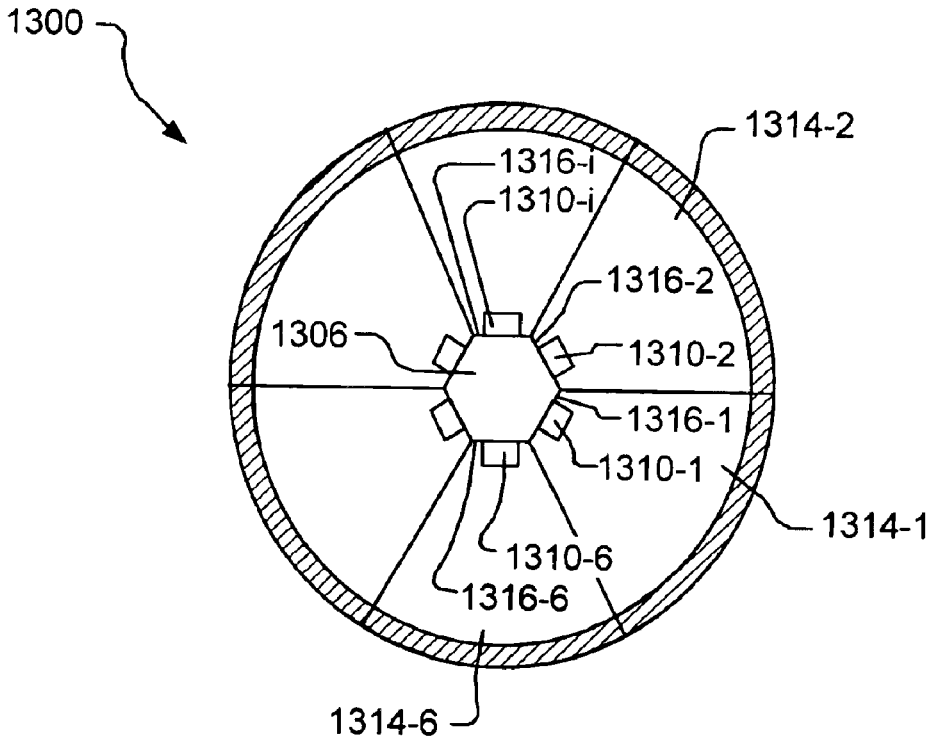

FIG. 12 illustrates another embodiment of lamp 200 (hereafter "lamp 1200") with five LED sources. A post 1206 has a pentagonal cross-section along its length. Post 1206 has five post facets 1216-1 to 1216-5 where LED sources 1210-1 to 1210-5 are mounted, respectively. Reflective segments 1214-1 to 1214-5 are tailored to LED sources 1210-1 to 1210-5, respectively. Similarly, FIG. 13 illustrates another embodiment of lamp 200 (hereafter "lamp 1300") with six LED sources. A post 1306 has a hexagonal cross-section along its length. Post 1306 has six post facets 1316-1 to 1316-6 where LED sources 1310-1 to 1310-6 are mounted, respectively. Reflective segments 1314-1 to 1314-6 are tailored to LED sources 1310-1 to 1310-6, respectively.

As described above with lamp 300, lamps 800, 1000, 1200, and 1300 can better shape its far-field pattern if OONC lenses are mounted on the LEDs in their LED sources to eliminate cross-talk between adjacent LED sources.

Figure 14:
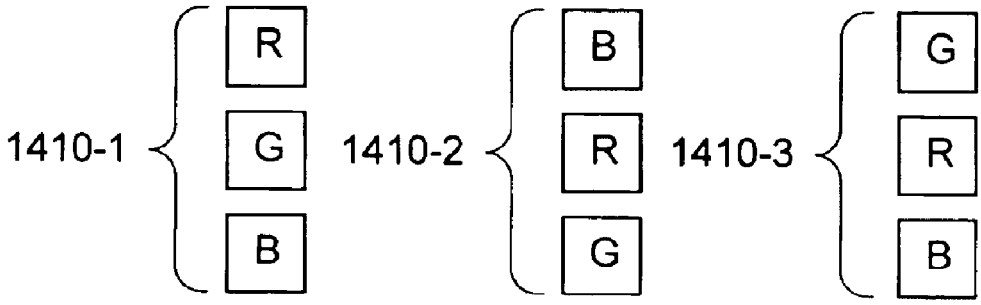
FIG. 14 illustrates LED sources with LEDs of different colors used on the same post facet to generate white light in one embodiment.

FIG. 14 illustrates LED sources 1410-1, 1410-2, and 1410-3 that can be included in embodiments of lamp 200. LED sources 1410-1 to 1410-3 include arrays of individual LEDs in different colors. For example, each LED source includes an array of red, green, and blue LEDs. Using an array of different color LEDs allows color mixing to form light of another color, such as white light. The colors of each LED source are arranged in different orders to better mix the colors. Although three LED sources 1410-1 to 1410-3 are shown, different colors, combinations, and number of LEDs may be used. Similarly described earlier, LED sources 1410-1 to 1410-3 can be a monolithic die with an array of LEDs or an array of individual LEDs.

Figure 15:
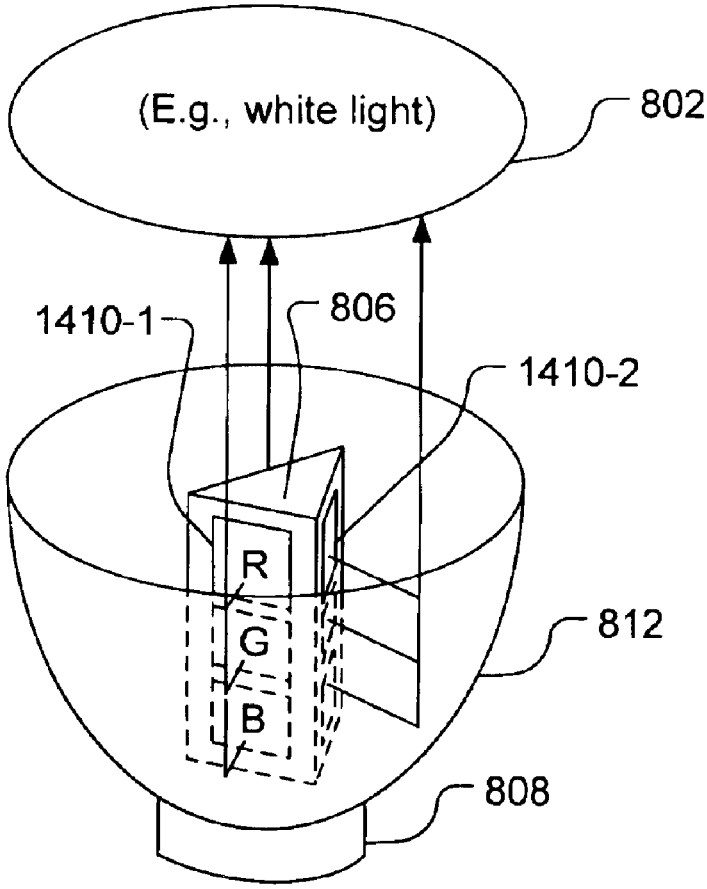
FIG. 15 illustrates a lamp with white light of FIG. 14 in one embodiment.

FIG. 15 illustrates one embodiment of lamp 800 that includes LED sources 1410-1 to 1410-3. Lights emitted by each of the axially arranged LED sources 1410-1 to 1410-3 travel to reflector 812 and are mixed with lights of different colors. Reflective segments overlap the different emitted colors from the post to create a white light in pattern 802. In one embodiment, LEDs of the same color on different post facets are not placed in the same relative position along the post facet in order to improve color mixing. Experience has shown that a source using RGB LEDs is much more efficient than a phosphorous converted white source.

In one embodiment, reflector 812 does not fully mix the colors of the LED sources 1410-1 to 1410-3 in pattern 802. This allows lamp 800 to generate lights of different colors.

Alternatively, the intensity of the individual LEDs in LED sources 1410-1 to 1410-3 can be independently varied by changing their current levels to generate lights of different colors. The light color could change dynamically depending on the application.

In one embodiment, the LED sources could be of different colors. This would allow reflective segments to create patterns of different colors which, could be overlapped or separated depending on the application.

Figure 16:
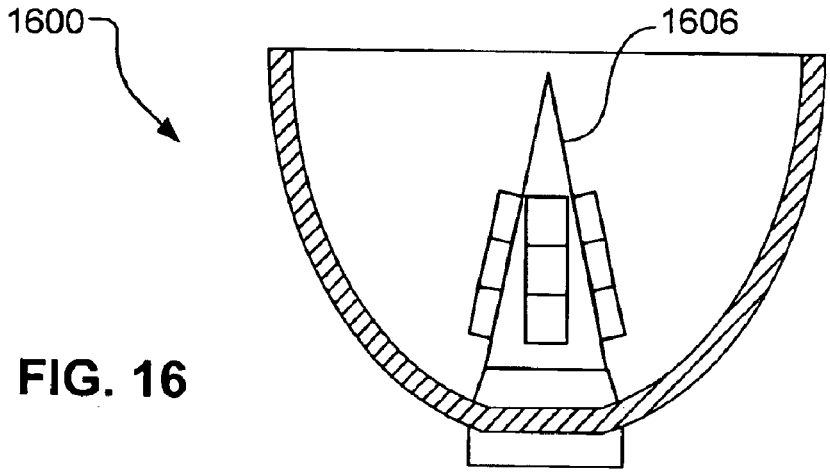
FIG. 16 illustrates a side view of a lamp with a cone-shaped post in one embodiment.
Figure 17:
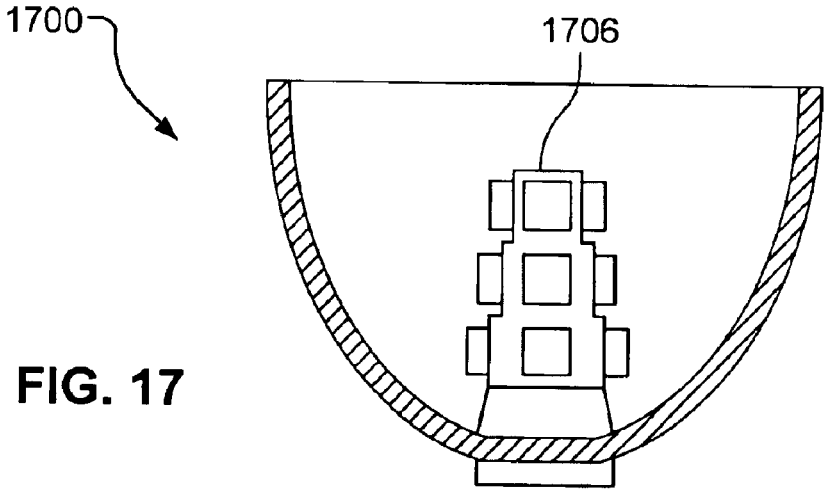
FIG. 17 illustrates a side view of a lamp with a stepped-shaped post in one embodiment.
Figure 18:
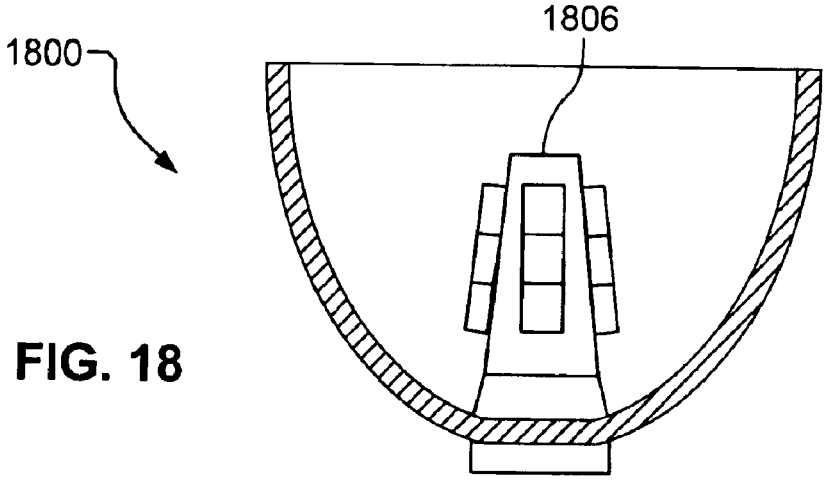
FIG. 18 illustrates a side view of a lamp with a pyramid-shaped post in one embodiment.

As mentioned above, post 206 can be made of various shapes to promote heat dissipation. Generally a post with incrementing cross-section along its length toward base 208 is preferred to conduct heat away from LED sources 210 toward base 208. Post 206 with incrementing cross-section can take on various shapes, including a cone-shaped post 1606 (FIG. 16), a stepped-shaped post 1706 (FIG. 17), and a pyramid-shaped post 1806 (FIG. 18). Depending on the shape of the post facets, the post facets may each accommodate a single LED source that is a monolithic die or an array of individual LEDs. Furthermore, the cross-section dimensions of the post can be increased to move the LED sources apart for better heat dissipation. Even through the LED sources are physically apart, the segmented reflector can optically shape the light pattern as if the LED sources are at the same physical location. In other words, the LED sources can be physically without optically spread apart.

Figure 20:
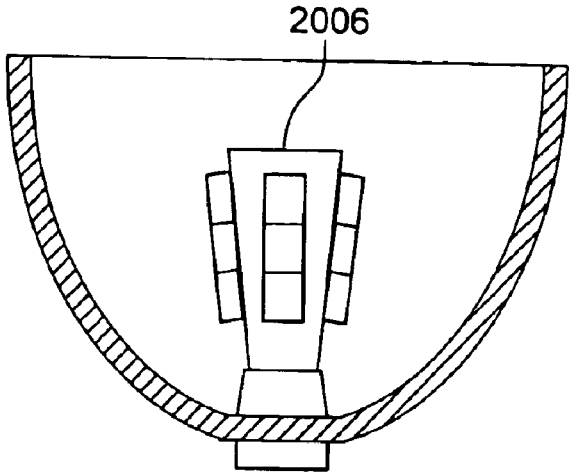
FIG. 20 illustrates a side view of a lamp with an inverted cone/pyramid-shaped post in one embodiment.
Figure 21:
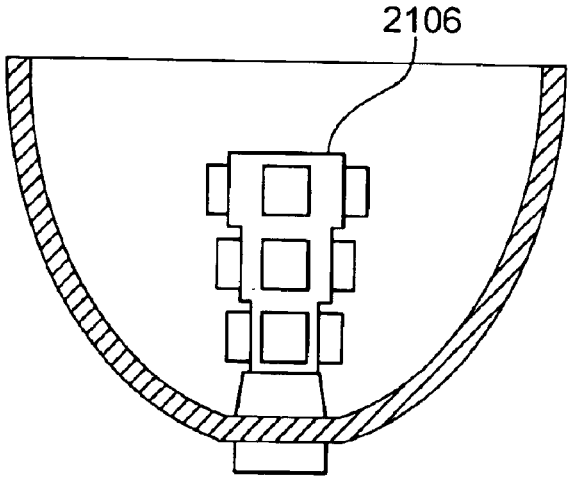
FIG. 21 illustrates a side view of a lamp with an inverted stepped-shaped post in one embodiment.
Figure 22:
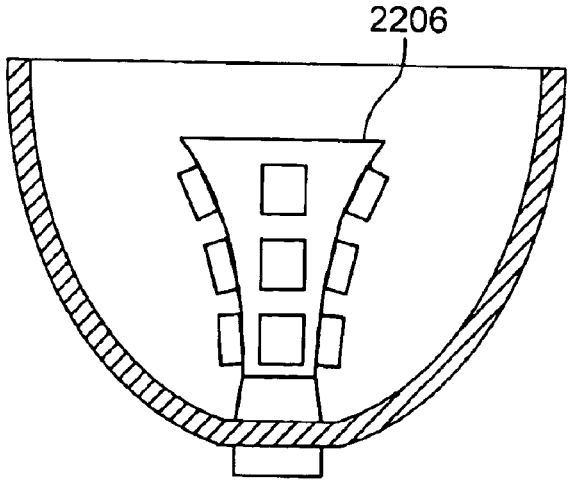
FIG. 22 illustrates a side view of a lamp with a post with curved post facets in one embodiment.

As mentioned above, post 206 can also be made of various shapes to promote optical collection. Generally, a post with decrementing cross-section along its length toward base 208 is preferred to focus the light of an LED source to its corresponding reflective segment. Post 206 with decrementing cross-section can take on various shapes, including an inverted pyramid-shaped post 2006B (FIG. 20), an inverted stepped-shaped post 2106B (FIG. 21), and an inverted pyramid-shaped post 2206B (FIG. 22) with a curved (e.g., parabolic) surface. FIG. 20 can also be used to illustrate an inverted cone-shaped post.

Figure 19A:
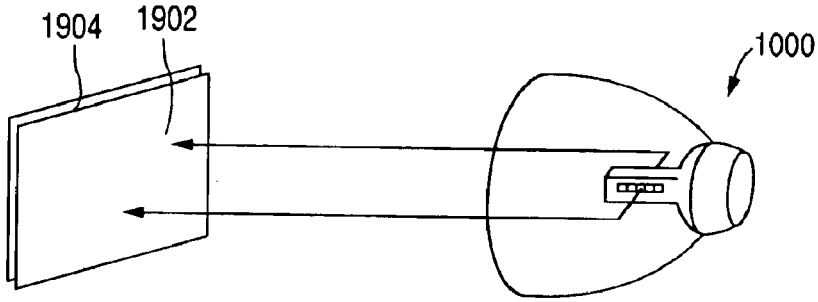
FIGS. 19A and 19D illustrate perspective views of the lamp of FIGS. 10A and 10B used to generate overlapping and non-overlapping images in a far-field pattern in two embodiments.
Figure 19B:
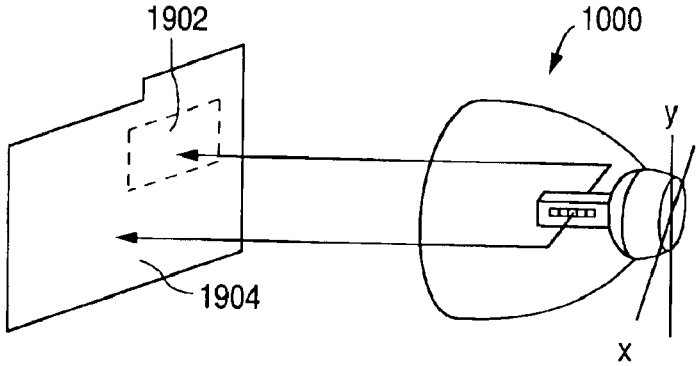
FIGS. 19B and 19C illustrate perspective views of the lamp of FIGS. 10A and 10B used to generate overlapping and partially overlapping images in a far-field pattern in two embodiments.
Figure 19C:
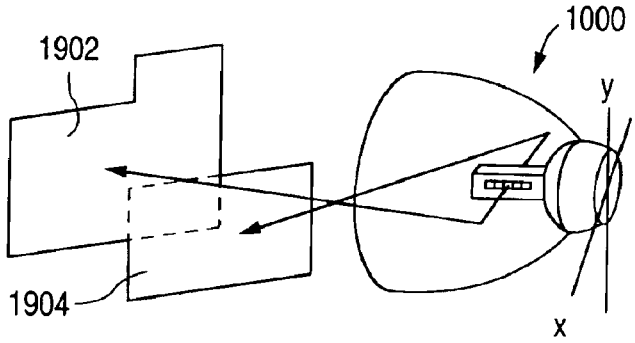

FIGS. 19A, 19B, and 19C illustrate one embodiment of lamp 1000 (FIGS. 10A and 10B) where LED sources 1010-1 and 1010-3 (FIG. 10B) are independently turned on to generate respective patterns 1902 and 1904 that at least partially overlap each other as part of a far-field pattern. In other words, LED sources 1010-1 and 1010-3 are independently controlled by changing their current levels. Such an arrangement as in FIG. 19A generates a bright pattern and improves robustness if any LED source is not manufactured properly or fails in operation. In one embodiment, LED sources 1010-1 and 1010-3 generate lights of different colors. Thus, the overlap of patterns 1902 and 1904 generate light that is a combination of the colors of LED sources 1010-1 and 1010-3.

FIGS. 19B and 19C illustrate other examples of partially or fully overlapping patterns. If LED sources produce lights of different colors, then an overlapping area has a color that is the combination of the colors of the contributing LED sources while a non-overlapping area retains the color of the only contributing LED source.

Figure 19D:
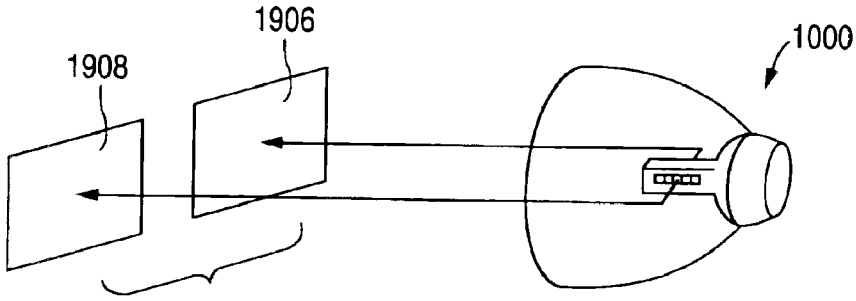

FIG. 19D illustrates another embodiment of lamp 1000 where LED sources 1010-1 and 1010-3 are independently turned on to generate respective patterns 1906 and 1908 that form different parts of a far-field pattern 1909. In one embodiment, LED sources 1010-1 and 1010-3 generate lights of different colors.

The lamps described above are well suited for various applications, including creating dynamic lighting where the light pattern is adaptively changed. For example, dynamic lighting for a vehicle (e.g., a car) consists of changing the light pattern according to the environment or the orientation of the car. When a car is traveling down the freeway, the driver may desire a high beam pattern that allows the driver to see far down the road. When the car is traveling down the street, the driver may desire a low beam pattern that allows the driver to see a relatively shorter distance down the road. The lamps described above can generate different light patterns by tailoring the corresponding LED sources and their associated reflective segments. Thus, LED source and associated reflective segment can be used to generate a part of a desired light pattern.

Various other adaptations and combinations of features of the embodiments disclosed are within the scope of the invention. For example, embodiments of lamp 200 can be used in commercial lighting to generate a narrow flood light pattern or a wide flood light pattern. In one embodiment, a first group of LED sources can be powered up to generates the narrow flood light pattern while a second group of LED sources can be powered up to generate the wide flood light pattern. Numerous embodiments are encompassed by the following claims.

What is claimed is:

1. A lamp, comprising:

a post aligned along a lamp axis;

a plurality of LED sources mounted on the post, wherein normal vectors to light emitting surfaces of the LED sources are approximately perpendicular to the lamp axis; and a reflector for guiding light primarily along the lamp axis, wherein the reflector is comprises reflective segments each optimized for a different LED source, so that each LED source primarily illuminates a different reflective segment.

2. The lamp of claim 1, wherein the post has an incrementing cross- section along its length toward a base of the lamp to conduct heat away from the LED sources and to the base.

3. The lamp of claim 2, wherein the post comprises a cone, a stepped, or a pyramid shape.

4. The lamp of claim 1, wherein the post comprises a triangular, rectangular, pentagonal, or hexagonal cross-section along its length.

5. The lamp of claim 1, wherein the reflective segments each comprises a focus located at a different LED source.

6. The lamp of claim 1, wherein the LED sources each comprises a monolithic LED die with an array LEDs, an array of individual LEDs, or an individual LED.

7. The lamp of claim 6, wherein each LED includes an optic-on-chip lens atop of its light emitting surface to control its solid angle of light emission so each LED primarily emits ligt onto only one of the reflective segments.

8. The lamp of claim 6, wherein the LED sources comprise LEDs of different sizes.

9. The lamp of claim 7, wherein the post has a decrementing cross-section along its length toward a base of the lamp so the LED sources are angled from the lamp axis.

10. The lamp of claim 9, wherein the post comprises an inverted cone, an inverted stepped shape, or an inverted pyramid shape.

11. The lamp of claim 9, wherein the post comprises curved post facets.

12. The lamp of claim 1, wherein the post includes an axial heat pipe along its length to conduct heat away from the LED sources and to a base of the lamp.

13. The lamp of claim 12, further comprising a heat sink coupled to the axial heat pipe.

14. The lamp of claim 13, wherein the heat sink comprises a plurality of fins coupled to the axial heat pipe.

15. The lamp of claim 12, further comprising a lateral heat pipe coupled to the axial heat pipe.

16. The lamp of claim 15, wherein the axial heat pipe has a screw base and the lateral heat pipe has a threaded bore for receiving the screw base.

17. The lamp of claim 12, wherein the axial heat pipe has an incrementing cross-section along its length toward the base of the lamp.

18. The lamp of claim 1, wherein each the LED sources each comprises an array of individual LEDs of different colors.

19. The lamp of claim 18 wherein the reflector mixes the different colors to project a far-field pattern that includes white light.

20. The lamp of claim 18, wherein the reflector partially mixes the different colors.

21. The lamp of claim 18, wherein the LEDs of the same color on at least two different LED sources are not placed in the same relative position along the post.

22. The lamp of claim 1, wherein the reflector projects light from different LED sources into non-overlapping parts of a far-field pattern.

23. The lamp of claim 1, wherein the reflector projects light from different LED sources to overlay each other in a far-field pattern.

24. The lamp of claim 1, wherein the LED sources are of different colors and the reflector at least partially mixes different colors of the LED sources to project a far-field pattern.

25. The lamp of claim 1, wherein the LED sources are of different colors and the reflector does not mix the different colors of the LED sources to project a far-field.

26. The lamp of claim 1, further comprising an optical structure on the post to direct light from one of the LED sources to one of the reflector segments.

27. The lamp of claim 26, wherein the optical structure comprises a first reflector and a second reflector on the post.

28. A method for generating a far-field pattern with a lamp having a plurality of LED sources on a post aligned with a lamp axis and a reflector including reflective segments each optimized for a different LED source so that each LED source primarily illuminates a different reflective segment the method comprising: independently controlling (1) a first LED source and (2) a second LED source to generate the far-field pattern.

29. The method of claim 28, wherein said independently controlling comprises: independently changing current levels to (1) the first LED source and (2) the second LED source to shape the far-field pattern.

30. The method of claim 28, whrein the first LED source and the second LED source generate at least partially overlapping patterns in the far-field pattern.

31. The method of claim 28, wherein the first LED source and the second LED source generate non-overlapping patterns in the far-field pattern.

32. The method of claim 28, wherein the first LED and the second LED are of different sizes.

33. The method of claim 28, wherein the far-field pattern is at least a part of a low beam pattern, a high beam pattern, a spread light pattern, or a sign light pattern.

34. The method of claim 28, wherein the far-field pattern is at least a part of a beam pattern, a high beam patttern, a spread light pattern, or a sight light pattern.

35. The method of claim 28, wherein the first LED source and the second LED source generate lights of different colors.

36. The method of claim 35, wherein said independently controling comprises: independently changing current levels to (1) the first LED source and (2) the second LED source to generate the far-field pattern including a desired color.

37. The method of claim 36, wherein the first LED source and the second LED source generate overlapping patterns in the far-field pattern.

38. The method of claim 36, wherein the first LED source and the second LED source generate non-overlapping patterns in the far-field pattern.

39. The method of claim 28, wherein the first LED source comprises a first LED and a second LED of different colors.

40. The method of claim 39, wherein said independent controlling comprises changing current levels to the first LED source and the second LED source.

* * * * *